US007091920B2

(12) United States Patent
Yuanzhu

(10) Patent No.: US 7,091,920 B2
(45) Date of Patent: Aug. 15, 2006

(54) CIRCULAR POLARIZATION SLOT ANTENNA APPARATUS CAPABLE OF BEING EASILY MINIATURIZED

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/985,293

(22) Filed: Nov. 10, 2004

(65) Prior Publication Data

US 2005/0104793 A1 May 19, 2005

(30) Foreign Application Priority Data

Nov. 18, 2003 (JP) ..... 2003-388233

(51) Int. Cl.
*H01Q 13/10* (2006.01)

(52) U.S. Cl. ..... 343/770; 343/767

(58) Field of Classification Search ..... 343/767, 343/770, 713, 711, 700 MS, 771, 846; H01Q 13/10
See application file for complete search history.

(56) References Cited

U.S. PATENT DOCUMENTS

| | | | | |
|---|---|---|---|---|
| 4,371,877 | A * | 2/1983 | Doussot et al. | 343/770 |
| 4,803,494 | A * | 2/1989 | Norris et al. | 343/770 |
| 6,593,891 | B1 | 7/2003 | Zhang | |
| 6,646,618 | B1 * | 11/2003 | Sievenpiper | 343/770 |
| 2003/0122726 | A1 | 7/2003 | Abbasi et al. | |
| 2004/0196200 | A1 * | 10/2004 | Sievenpiper | 343/770 |

FOREIGN PATENT DOCUMENTS

| | | |
|---|---|---|
| DE | 100 59 027 | 6/2001 |
| JP | 07-226618 | 8/1995 |
| JP | 2003-234615 | 8/2003 |
| WO | WO 02/084800 | 10/2002 |

OTHER PUBLICATIONS

*Compact Circularly-Polarised Circular Microstrip Antenna With Cross-slot and Peripheral Cuts*, Wen-Shyang, Chen et al, Electronics Letters, May 28, 1998, vol. 34 No. 11, XP006009860.

*Single-Feed Circularly Polarized Equilateral-Triangular Microstrip Antenna with a Tuning Stub*, Jui-Han, Lu et al., IEEE Transactions On Antennas and Propagation, Dec. 2000, vol. 48, No. 12, XP001005156.

Copy of Search Report dated Dec. 14, 2004 for European Patent Application No. EP 04 02 6802.

* cited by examiner

*Primary Examiner*—Hoanganh Le
(74) *Attorney, Agent, or Firm*—Brinks Hofer Gilson & Lione

(57) ABSTRACT

A slot antenna apparatus 10 contains a circuit substrate having a high-frequency circuit arranged therein and a shield case accommodating the circuit substrate. A cross-shaped slot and a feeding pin are formed in an upper plate of the shield case. The cross-shaped slot is composed of first and second slots. The lengths of the slots are different and the slots are perpendicular to each other. The shortest distances from the feeding pin to the first slots are approximately equal. When the power is fed to the upper plate through the feeding pin, the slots are excited to irradiate linearly polarized waves perpendicular to each other, respectively.

5 Claims, 3 Drawing Sheets

CIRCULAR POLARIZATION SLOT ANTENNA APPARATUS CAPABLE OF BEING EASILY MINIATURIZED

This application claims the benefit of priority to Japanese Patent Application No. 2003-388233 filed on Nov. 18, 2003, herein incorporated by reference.

BACKGROUND OF THE INVENTION

1. Field of the Invention

The present invention relates to a slot antenna apparatus, and more particularly, to a slot antenna apparatus which is operated as a circular polarization antenna.

2. Description of the Related Art

A slot antenna apparatus comprises a conductor member composed of a metal foil or a metal plate in which a slot having a predetermined size is formed and a circuit substrate in which a high-frequency circuit including an amplifier, an oscillator or the like is arranged. By feeding a power to an appropriate location of the conductor member through a feeding means such as a feeding line connected to the circuit substrate, a slot is excited and a linearly polarized wave can be irradiated. As a conventional example of such a slot antenna apparatus, an antenna apparatus in which an antenna unit is provided at one side of the circuit substrate is widely known (for example, see Japanese unexamined Patent Application Publication No. 2003-234615 (Pages 3 to 4, FIG. 3)).

FIG. 6 is a plan view of essential elements of a conventional slot antenna apparatus and shows an antenna unit 2 provided at one side of a substrate 1 composed of a dielectric. In FIG. 6, on one surface of the substrate 1, a conductor layer 4 having a slot 3 is formed, and on the other surface of the substrate 1, a feeding line 5 traversing the slot 3 in a width direction is formed. In addition, the extending portion (not shown) of the substrate 1 forms a circuit unit 6 in which a high-frequency circuit is arranged. The conductor layer 4 or the feeding line 5 is formed by patterning copper foil or the like and a rectangular opening surrounded by the conductor layer 4 forms the slot 3. The length of the slot 3 is set to about half of the resonance length $\lambda$. The feeding line 5 is a micro-strip line connected to the circuit unit 6. By feeding the power to both ends of the slot 3 in a width direction through the feeding line 5, the slot 3 can be excited.

However, the conventional slot antenna apparatus is generally designed as the linear polarization antenna. But, when an additional slot extending in a direction perpendicular to a longitudinal direction of the slot 3 is formed in the vicinity of the slot 3 and is excited with a phase difference of about 90 degrees with respect to a resonance mode of the slot 3 in FIG. 6, a circular polarization slot antenna apparatus is obtained. However, since the conventional antenna uses the extending portion (one side) of the substrate 1 in which the high-frequency circuit is arranged as a region of an antenna unit 2, when a pair of circular polarization slots and a pair of feeding lines are formed in the antenna unit 2, a wide space is required in the antenna unit 2 so that an area of the substrate 1 increases. As a result, the miniaturization of the overall apparatus cannot be accomplished. Further, in order to generate the phase difference of about 90 degrees in the resonance modes of the pair of slots, the phase difference circuit unit of 90 degrees must be provided in the feeding circuit. This results in the circuit structure becoming complex and the cost increasing.

Moreover, in order to minimize the slot antenna apparatus, the structure that the high-frequency circuit, the feeding line and the conductor layer having the slot are provided in each layer of the multilayered substrate can be considered. However, if the multilayered substrate is employed, the cost thereof increases greatly because the manufacturing process thereof is complex.

SUMMARY OF THE INVENTION

Accordingly, the present invention has been made to solve the above-mentioned problems, and it is an object of the present invention to provide a circular polarization slot antenna apparatus which can be cheaply manufactured and can be easily miniaturized.

In order to achieve the above-mentioned object, a slot antenna apparatus according to the present invention comprises a conductor member having a cross-shaped slot composed of a first slot and a second slot therein, the first and second slots being perpendicular to each other; a feeding pin for feeding the power to the conductor member at a predetermined location spaced from the cross-shaped slot; and a circuit substrate connected to the feeding pin and having a high-frequency circuit arranged therein, wherein the first and second slots are excited by feeding the power through the feeding pin, and the second slot is excited with a phase difference of about 90 degrees with respect to the resonance mode of the first slot such that the slot antenna apparatus is operated as a circular polarization antenna.

In the slot antenna apparatus having the above-mentioned structure, since the cross-shaped slot having the first slot and the second slot which are perpendicular to the each other is used and the power is fed to the conductor member at a predetermined location spaced from the cross-shaped slot, the phase difference of about 90 degrees is generated between the resonance modes of the first and second slots. Thereby, the feeding circuit is not complex and the circular polarization slot antenna apparatus can be cheaply manufactured. In addition, since the power is fed to the conductor member having the cross-shaped slot through the feeding pin, the other surface of the circuit substrate having a high-frequency circuit at one surface thereof is provided with the conductor member and the feeding pin using a through-hole of the circuit substrate is connected to the conductor member. Thereby, the miniaturization of the circular polarization slot antenna apparatus can be cheaply facilitated without employing the multilayered substrate.

Further, in the case in which the shortest distance from the feeding pin to the first slot is approximately equal to the shortest distance from the feeding pin to the second slot, by differentiating the lengths of the first and second slots from each other by a predetermined size, the first and second slots can be excited with the phase difference of about 90 degrees. Also, in the case in which the lengths of the first and second slots are approximately equal to each other, by setting the location of the feeding pin such that the shortest distance from the feeding pin to the first slot is different from the shortest distance from the feeding pin to the second slot by a predetermined size, the first and second slots can be excited with the phase difference of about 90 degrees.

In the above-mentioned slot antenna apparatus, it is preferable that the conductor member be composed of a metal plate, a metal piece made by cutting and erecting a portion of the metal plate be used as the feeding pin, and the front end of the feeding pin be connected to the circuit substrate. Thereby, since the cross-shaped slot and the feeding pin can easily and accurately formed by manufacturing one metal plate by a press machining, the cost thereof can be remarkably reduced. In this case, it is more preferable that the shield case for accommodating the circuit substrate be used. Specifically, by forming the cross-shaped slot in one surface of the shield case and cutting and erecting a portion of the feeding pin, the surface is used as the conductor member. Accordingly, the conductor member used exclusively by the antenna is not needed, and thus the circular polarization slot antenna apparatus can be cheaply manufactured.

Further, in the slot antenna apparatus having the above-mentioned structure, in the case in which the closed ends of the first and second slots is wider than the other thereof, the resonance frequency is lower, when compared to the case in which the closed ends are equal to the other thereof in width. This results in easily facilitating the miniaturization of the overall apparatus.

Furthermore, in the slot antenna apparatus having the above-mentioned structure, in the case in which the conductor member has cut portions at the locations respectively opposite to the closed ends of the first and second slots, the bandwidth become wide, when compared to the case in which there is not a cut portion.

DESCRIPTION OF THE PREFERRED EMBODIMENTS

Figure 1:
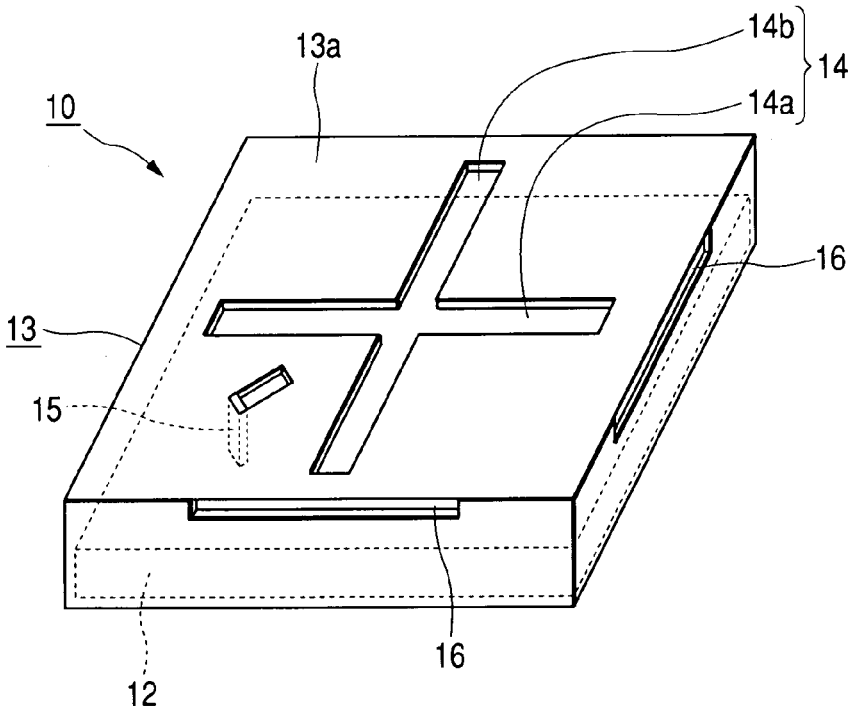
FIG. 1 is a perspective view of a slot antenna apparatus according to a first embodiment of the present invention.

Hereinafter, embodiments of the present invention will now be described with reference to the accompanying drawings. FIG. 1 is a perspective view of a slot antenna apparatus according to a first embodiment of the present invention, FIG. 2 is a sectional view of the slot antenna apparatus according to the first embodiment of the present invention, and FIG. 3 is a plan view of the slot antenna apparatus according to the first embodiment of the present invention.

Figure 2:
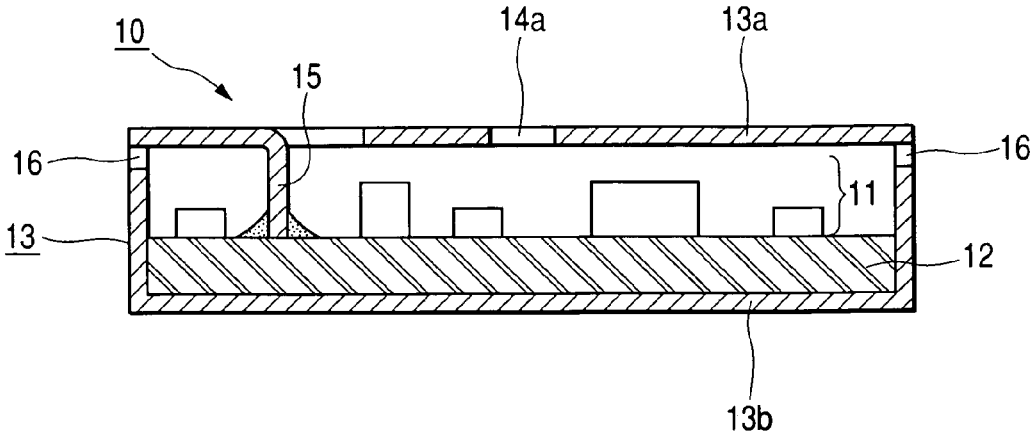
FIG. 2 is a sectional view of the slot antenna apparatus shown in FIG. 1.
Figure 3:
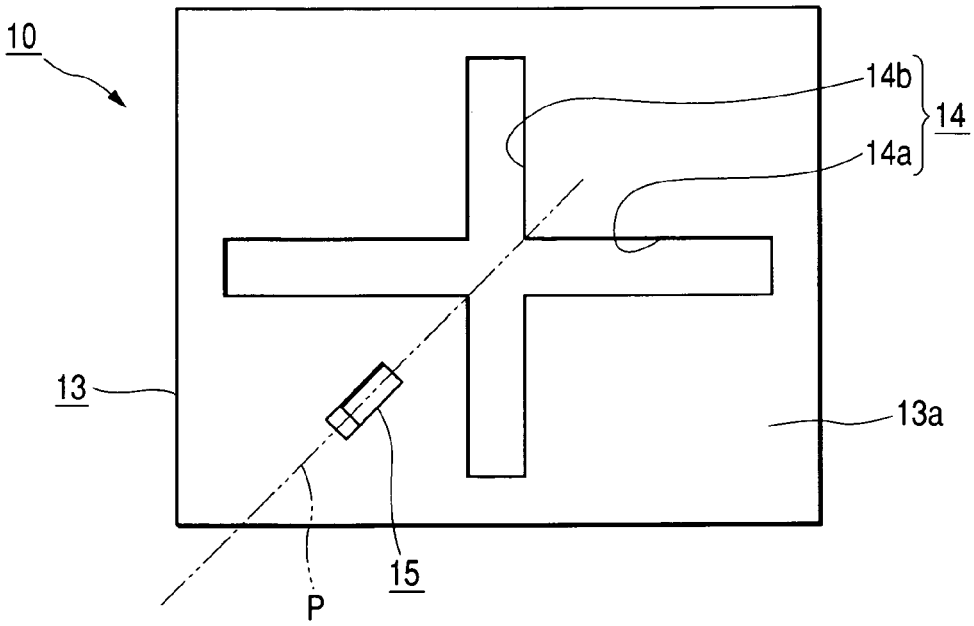
FIG. 3 is a plan view of the slot antenna apparatus shown in FIG. 1.

As shown in FIGS. 1 to 3, the slot antenna apparatus 10 comprises a circuit substrate 12 in which a high-frequency circuit 11 including as an amplifier, an oscillator or the like is arranged and a shield case 13 which is a case body accommodating the circuit substrate 12 and is composed of an excellent conductive metal plate. A cross-shaped slot 14 and a feeding pin 15 are formed in an upper plate 13*a* of the shield case 13. The cross-shaped slot 14 formed in the upper plate 13*a* is composed of a first slot 14*a* and a second slot 14*b*. The length of the first slot 14*a* is different from that of the second slot 14*b*, and the first slot 14*a* and the second slot 14*b* are punched so as to be perpendicular to each other. In this embodiment, the length of the first slot 14*a* is larger than that of the second slot 14*b*. The feeding pin 15 is a metal piece that a part of the upper plate 13*a* is cut and is erected, and the front end (the lower end) of the feeding pin 15 is soldered to the feeding circuit of the circuit substrate 12. The feeding pin 15 is formed at a predetermined location spaced from the cross-shaped slot 14. However, the shortest distance from the feeding pin 15 to the first slot 14*a* is approximately equal to the shortest distance from the feeding pin 15 to the second slot 14*b*. In other words, the feeding pin 15 is located on a straight line P which is inclined by about 45 degree with respect to each of the first and second slots 14*a* and 14*b* and passes through the intersection point of the first and second slots 14*a* and 14*b*.

In addition, when the power is fed to the upper plate 13*a* through the feeding pin 15, the first slot 14*a* and the second slot 14*b* are excited to irradiate the linearly polarized waves perpendicular to each other. However, since the lengths of the first and second slots 14*a* and 14*b* are different from each other by a predetermined size, a phase difference of about 90 degrees is generated in the resonance mode of each of the first and second slots 14*a* and 14*b*. Accordingly, the slot antenna apparatus 10 is operated as the circular polarization antenna for irradiating the circularly polarized wave from the cross-shaped slot 14.

Moreover, since the high-frequency circuit 11 is covered with the shield case 13, it is shielded from an external wave to ensure high reliability. In addition, since the lower plate 13*b* of the shield case 13 functions as a reflector for reflecting the radio waves which are irradiated from the cross-shaped slot 14 to the lower direction, the radio wave irradiated to the upper direction is strong and thus an excellent directivity of the slot antenna apparatus 10 can be expected.

Further, the shied case 13 has cut portions 16 formed respectively at the locations opposite to closed ends of the first and second slots 14*a* and 14*b*. Since the cut portions 16 function as a capacitor provided in a magnetic field region (a maximum current region) of each of the slots 14*a* and 14*b*, a current path in the magnetic filed region can be varied depending on the frequency. Accordingly, by providing the cut portions 16, a bandwidth of the slot antenna apparatus 10 can become wide.

In the slot antenna apparatus 10 according to the first embodiment, a cross-shaped slot 14 in which the first slot 14*a* and the second slot 14*b* are perpendicular to each other is formed, and the power is fed to the upper plate 13*a* at a predetermined location spaced from the cross-shaped slot 14 so that the phase difference of about 90 degrees is generated between the resonance mode of the first slot 14*a* and the resonance mode of the second slot 14*b*. As a result, the slot antenna apparatus can be operated as the circular polarization antenna without the feeding circuit being complex. In addition, since the shield case 13 accommodating the circuit substrate 12 is used and the cross-shaped slot 14 and the feeding pin 15 are formed in the upper plate 13*a* in the slot antenna apparatus 10, the number of the components is small and thus the size of the slot antenna apparatus can be reduced. Moreover, the cross-shaped slot 14 or the feeding pin 15 can be easily and accurately formed by a press machining. Therefore, the slot antenna apparatus 10 can be cheaply manufactured and can be easily miniaturized.

Figure 4:
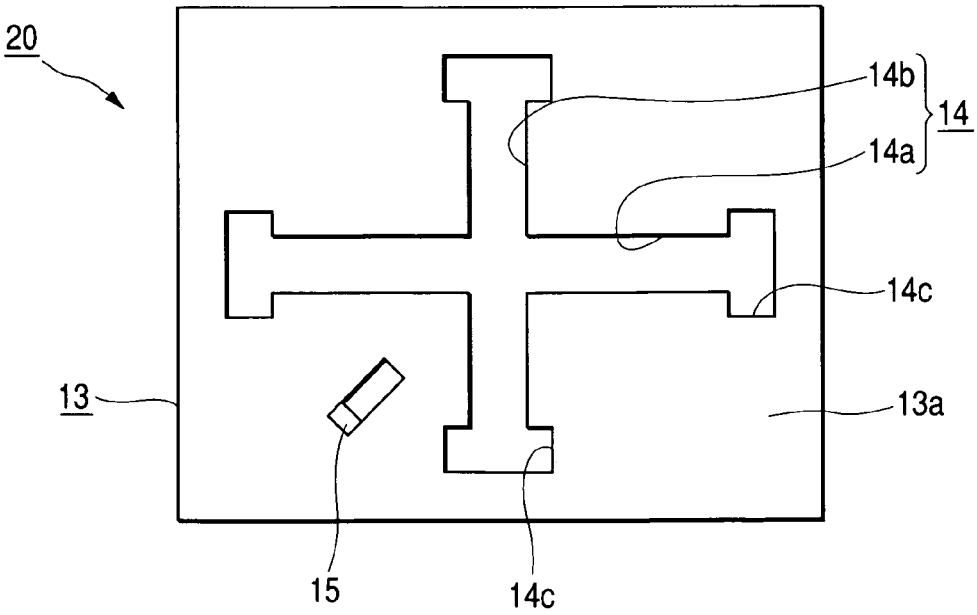
FIG. 4 is a plan view of a slot antenna apparatus according to a second embodiment of the present invention.

FIG. 4 is a plan view of a slot antenna apparatus according to a second embodiment of the present invention, and constituent elements corresponding to the constituent elements of FIG. 3 are denoted by the same reference numerals. A slot antenna apparatus 20 according to the second embodiment shown in FIG. 4 is different from that of the first embodiment in that wide portions 14*c* wider than that of the other portion of the slot are formed in the vicinities of closed ends of the first and second slots 14*a* and 14*b*. When the width of the closed end that is a magnetic field region (maximum current region) becomes wide in each of the slots

14*a* and 14*b*, the length of a current path increases and thus a resonance frequency lowers. Accordingly, the length of each of the slots 14*a* and 14*b* required to resonate at a specific frequency can be reduced and thus the miniaturization of the entire antenna apparatus can be easily achieved.

Figure 5:
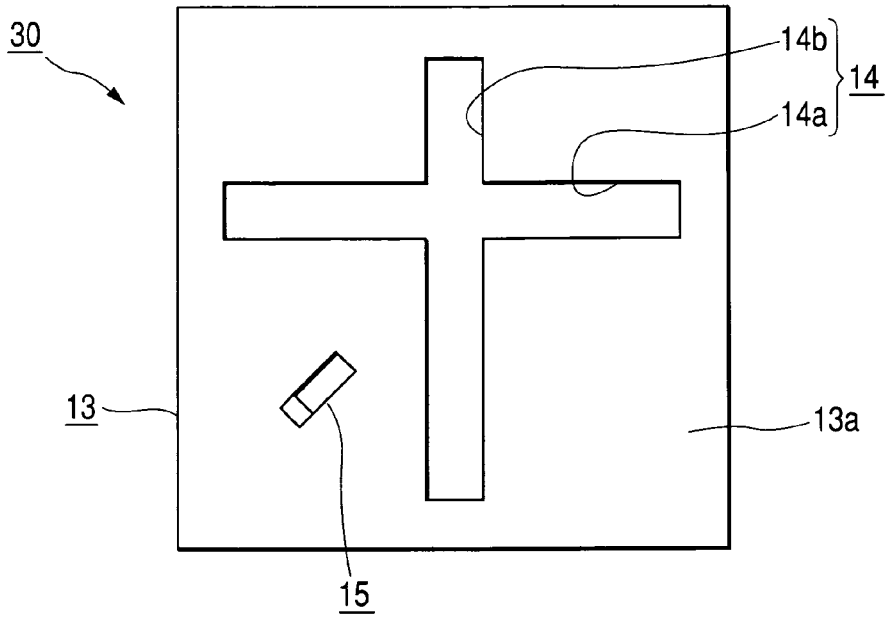
FIG. 5 is a plan view of a slot antenna apparatus according to a third embodiment of the present invention.
Figure 6:
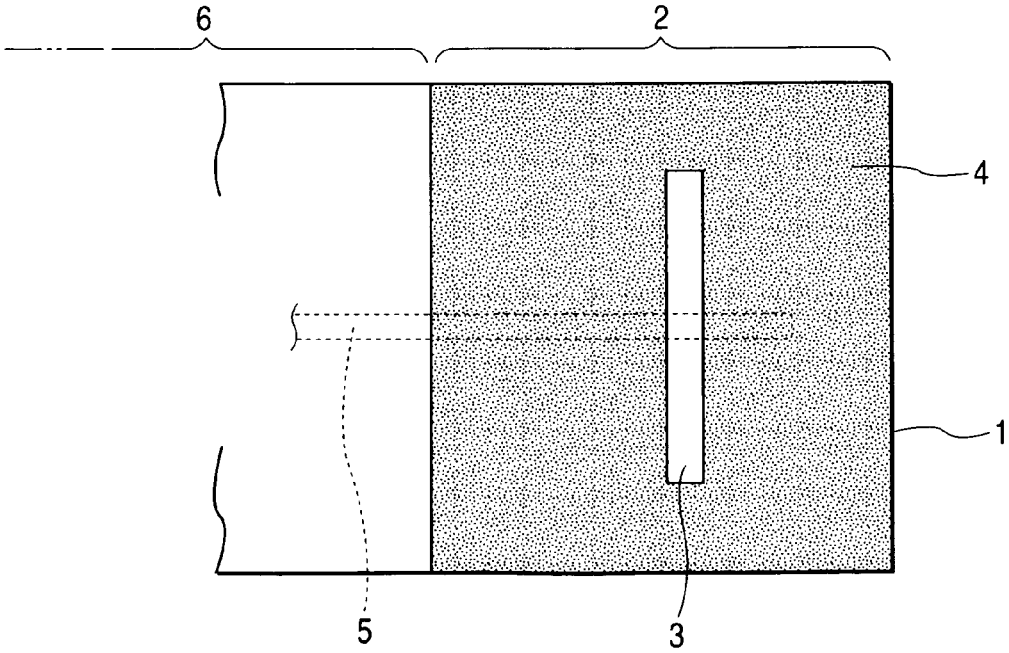
FIG. 6 PRIOR ART
FIG. 6 is a plan view of essential elements of a conventional slot antenna apparatus.

FIG. 5 is a plan view of a slot antenna apparatus according to a third embodiment of the present invention, and constituent elements corresponding to the constituent elements of FIG. 3 or 4 are denoted by the same reference numerals. A slot antenna apparatus 30 shown in FIG. 5 is quite different from the first embodiment in that lengths of first and second slots 14*a* and 14*b* are approximately equal to each other, the first slot 14*a* offsets from a center point of the second slot 14*b*, and the shortest distance from the feeding pin 15 to the first slot 14*a* is larger the shortest distance from the feeding pin 15 to the second slot 14*b* by a predetermined size. The slot antenna apparatus 30 in which the location of the feeding pin 15 and the shape of the cross-shaped slot 14 are set as mentioned above can excite the first and second slots 14*a* and 14*b* with the phase difference of about 90 degrees and thus is operated as the circular polarization antenna.

In addition, although the cross-shaped slot is formed in the metal plate in the above-mentioned embodiments, the metal foil such as copper may be patterned on the surface of the substrate to form the cross-shaped slot. For example, when the metal foil is patterned on the other surface of the circuit substrate having the high-frequency circuit formed on one surface to form the cross-shaped slot and the feeding pin using a through-hole of the circuit substrate is connected to a predetermined location of the metal foil, the miniaturization of the circular polarization slot antenna apparatus can be achieved without employing a multilayered substrate.

In the slot antenna apparatus according to the present invention, the cross-shaped slot having the first slot and the second slot which are perpendicular to each other is used, the power is fed to the conductor member at a predetermined location spaced from the cross-shaped slot, the second slot is excited with a phase difference of about 90 degrees with respect to the resonance mode of the first slot, and the slot antenna apparatus is operated as a circular polarization antenna. As a result, the circular polarization slot antenna apparatus can be cheaply manufactured with a small size, without the feeding circuit becoming complex or employing the multilayered substrate.

Particularly, in the case in which the conductor member having the cross-shaped slot therein is composed of the metal plate and the metal piece made by cutting and erecting a portion of the metal plate is used as the feeding pin, the cross-shaped slot and the feeding pin can be easily and accurately formed by manufacturing one metal plate by a press machining. This results in the cost decreasing greatly. Also, in the case of employing the shield case for accommodating the circuit substrate as the metal plate, the conductor member used exclusively by the antenna is not needed and thus the circular polarization slot antenna apparatus can be cheaply manufactured.

What is claimed is:

1. A slot antenna apparatus, comprising:

a conductor member having a cross-shaped slot composed of a first slot and a second slot therein, the first and second slots being perpendicular to each other;

a feeding pin for feeding power to the conductor member at a predetermined location spaced from the cross-shaped slot; and a circuit substrate connected to the feeding pin and having a high-frequency circuit arranged therein, wherein the first and second slots are excited by feeding the power through the feeding pin, and the second slot is excited with a phase difference of about 90 degrees with respect to a resonance mode of the first slot such that the slot antenna apparatus is operated as a circular polarization antenna, wherein lengths of the first and second slots are approximately equal to each other, and a location of the feeding pin is set such that a shortest distance from the feeding pin to the first slot is different from a shortest distance from the feeding pin to the second slot by a predetermined size.

2. The slot antenna apparatus according to claim 1, wherein the conductor member is composed of a metal plate, a metal piece made by cutting and erecting a portion of the metal plate is used as the feeding pin, and a front end of the feeding pin is connected to the circuit substrate.

3. The slot antenna apparatus according to claim 2, further comprising:

a shield case for accommodating the circuit substrate, wherein one surface of the shield case is used as the conductor member.

4. The slot antenna apparatus according to claim 1, wherein closed ends of the first and second slots are wider than the other portion thereof.

5. The slot antenna apparatus according to claim 1, wherein the conductor member has cut portions at locations respectively opposite to closed ends of the first and second slots.

* * * * *